US006412767B1

(12) United States Patent
Beckmann et al.

(10) Patent No.: US 6,412,767 B1
(45) Date of Patent: Jul. 2, 2002

(54) CLAMPING JAW

(75) Inventors: Toby Jay Beckmann, Seward; Thomas Michael Chervenak, Beatrice; Anthony Bernard Fuller, DeWitt; Ryan Keith Hopper, Lincoln; Steven Edward Zlomke, Beatrice, all of NE (US)

(73) Assignee: American Tool Companies, Inc., Hoffman Estates, IL (US)

( * ) Notice: Subject to any disclaimer, the term of this patent is extended or adjusted under 35 U.S.C. 154(b) by 0 days.

(21) Appl. No.: 09/036,360

(22) Filed: Mar. 6, 1998

(51) Int. Cl.[7] ..... B25B 5/02

(52) U.S. Cl. ..... 269/166; 269/3; 269/6; 269/147; 269/170

(58) Field of Search ..... 269/166, 169, 269/3, 6, 147–149, 203–206; 81/487; D8/72; 403/326, 329, 279, 282, 384, 385

(56) References Cited

U.S. PATENT DOCUMENTS

| | | | | |
|---|---|---|---|---|
| 100,642 A | | 3/1870 | Lambert | |
| 153,206 A | | 7/1874 | Wagoner | |
| 226,617 A | | 4/1880 | Konig | |
| 267,152 A | | 11/1882 | Cloud | |
| 376,623 A | * | 1/1888 | Bain | 269/166 |
| 404,368 A | | 5/1889 | Stearns | |
| 408,473 A | | 8/1889 | Focken | |
| 410,815 A | | 9/1889 | Tarbell | |
| 416,096 A | | 11/1889 | Dom | |
| 491,633 A | | 2/1893 | Bourassa | |
| 669,282 A | * | 3/1901 | Lanpher | 269/166 |
| 678,805 A | | 7/1901 | Weyland | |
| 749,732 A | | 1/1904 | Hanson et al. | |
| 757,166 A | | 4/1904 | Wintsch, Jr. | |
| 775,659 A | | 11/1904 | Jorgensen | |
| 781,356 A | * | 1/1905 | Peelman | 269/166 |
| 792,758 A | | 6/1905 | Colt | |
| 927,067 A | | 7/1909 | Offineer | |
| 934,589 A | | 9/1909 | Bradford | |
| 1,241,215 A | | 9/1917 | Hoffman | |
| 1,340,092 A | | 5/1920 | Tuscher, Jr. | |
| 1,393,766 A | | 10/1921 | Du Charme | |
| 1,402,621 A | | 1/1922 | Knittel et al. | |

(List continued on next page.)

FOREIGN PATENT DOCUMENTS

| | | |
|---|---|---|
| AU | 225561 | 4/1959 |
| FR | 2 611 160 | 7/1994 |
| TW | U.M. 54745(136083) | 6/1990 |

OTHER PUBLICATIONS

"Pony Steel Bar Clamp Fixtures" styles 50, 52 and 56. Publication source and date unknown. It is believed that this publication was available to the public prior to Jul. 15, 1993. Bessey Steel Bar Clamp Fixture RS 75 instructions. Publication source and date unknown. It is believed that this publication was available to the public prior to Jul. 15, 1993. Advertisement for Bessey Bar Clamps Styles 52, 53 and 56. Publication source and date unknown. It is believed that this publication was available to the public prior to Jul. 15, 1993.

(List continued on next page.)

*Primary Examiner*—Joseph J. Haill, III
*Assistant Examiner*—Lee Wilson
(74) *Attorney, Agent, or Firm*—Brinks Hofer Gilson & Lione

(57) ABSTRACT

A method of attaching a clamping jaw to a support element comprising a stop element having the steps of positioning a stop element within a channel formed in the clamping jaw and blocking a first end of the channel and a second end of the channel so that the stop element is trapped between the first and second ends of the channel.

51 Claims, 9 Drawing Sheets

U.S. PATENT DOCUMENTS

| | | | | | |
|---|---|---|---|---|---|
| 1,452,753 | A | | 4/1923 | Otto et al. | |
| 1,543,197 | A | | 6/1925 | Ulrich | |
| 1,583,611 | A | | 5/1926 | Seely | |
| 1,639,561 | A | | 8/1927 | Hargrave | |
| 1,783,713 | A | | 12/1930 | Holman | |
| 1,811,518 | A | | 6/1931 | Palmer | |
| 1,890,042 | A | | 12/1932 | Morandi | |
| 2,133,892 | A | | 10/1938 | Gelinski | |
| 2,157,345 | A | | 5/1939 | Nelson | |
| 2,468,358 | A | | 4/1949 | Clark | |
| 2,656,864 | A | | 10/1953 | Hopfeld | |
| 2,781,803 | A | | 2/1957 | Nelson | |
| 2,815,053 | A | | 12/1957 | Walker | |
| 2,815,778 | A | | 12/1957 | Holman | |
| 2,923,334 | A | | 2/1960 | Brennan, Jr. | |
| 2,949,947 | A | | 8/1960 | Story | |
| 2,950,912 | A | * | 8/1960 | Blackmon et al. | 269/166 |
| 3,033,559 | A | | 5/1962 | Lindholm | |
| 3,159,393 | A | | 12/1964 | Villano | |
| 3,173,674 | A | | 3/1965 | Ringle | |
| 3,331,111 | A | | 7/1967 | Carver | |
| 3,575,405 | A | | 4/1971 | Harding | |
| 3,596,898 | A | | 8/1971 | Hilburn | |
| D222,872 | S | | 1/1972 | Boucher | |
| D227,192 | S | | 6/1973 | Schafhauser | |
| 3,806,107 | A | | 4/1974 | Pitzer et al. | |
| 3,914,830 | A | | 10/1975 | Bolton | |
| D238,140 | S | | 12/1975 | Guimarin | |
| 3,933,346 | A | | 1/1976 | Carver | |
| 3,963,230 | A | | 6/1976 | Jankowski, Jr. | |
| 4,042,264 | A | | 8/1977 | Shumer | |
| 4,078,781 | A | | 3/1978 | Fraser et al. | |
| 4,083,548 | A | | 4/1978 | Hackbarth | |
| 4,088,313 | A | | 5/1978 | Pearson | |
| 4,132,397 | A | | 1/1979 | Ward | |
| 4,143,869 | A | | 3/1979 | Paterson et al. | |
| D259,327 | S | | 5/1981 | Sloane | |
| 4,306,710 | A | | 12/1981 | Vosper | |
| 4,339,113 | A | | 7/1982 | Vosper | |
| 4,381,105 | A | | 4/1983 | Goff et al. | |
| D279,646 | S | * | 7/1985 | Ferdinand et al. | D8/72 |
| 4,563,921 | A | | 1/1986 | Wallace | |
| 4,582,306 | A | * | 4/1986 | Sassenberg | 269/134 |
| D286,369 | S | | 10/1986 | Hahn | |
| 4,874,155 | A | * | 10/1989 | Goul | 269/6 |
| 4,893,801 | A | | 1/1990 | Flinn | |
| 4,926,722 | A | * | 5/1990 | Sorensen et al. | 269/6 |
| 4,989,847 | A | | 2/1991 | Chapman | |
| 5,005,449 | A | | 4/1991 | Sorensen et al. | |
| 5,009,134 | A | * | 4/1991 | Sorensen et al. | 269/6 |
| 5,022,137 | A | * | 6/1991 | Sorensen et al. | 29/559 |
| D320,919 | S | * | 10/1991 | Sorensen | D8/72 |
| 5,094,131 | A | | 3/1992 | Sorensen et al. | |
| 5,096,170 | A | | 3/1992 | Albin | |
| D328,846 | S | | 8/1992 | Sorensen et al. | |
| 5,156,508 | A | | 10/1992 | Grisley | |
| 5,161,787 | A | | 11/1992 | Hobday | |
| 5,170,682 | A | | 12/1992 | Sorensen et al. | |
| D333,602 | S | * | 3/1993 | Gatzemeyer et al. | D8/72 |
| D333,963 | S | | 3/1993 | Goodman | |
| 5,197,360 | A | | 3/1993 | Wooster, Jr. | |
| 5,217,213 | A | * | 6/1993 | Lii | 269/6 |
| 5,222,420 | A | * | 6/1993 | Sorensen et al. | 269/6 |
| D340,632 | S | | 10/1993 | Easley | |
| D346,942 | S | | 5/1994 | Sawdon | |
| 5,326,076 | A | | 7/1994 | Sorensen et al. | |
| 5,346,194 | A | | 9/1994 | Coffin | |
| D355,104 | S | | 2/1995 | Sorensen et al. | |
| D357,165 | S | | 4/1995 | Sorensen et al. | |
| 5,443,246 | A | | 8/1995 | Peterson | |
| 5,454,551 | A | * | 10/1995 | Hobday | 269/6 |
| D365,263 | S | | 12/1995 | Sorensen et al. | |
| D366,820 | S | * | 2/1996 | Wooster, Jr. et al. | D8/72 |
| 5,692,734 | A | | 12/1997 | Aldredge, Sr. | |
| 5,775,680 | A | | 7/1998 | Sorensen et al. | |
| 5,826,310 | A | * | 10/1998 | Hobday | 269/6 |
| 5,853,168 | A | | 12/1998 | Drake | |

OTHER PUBLICATIONS

Advertisement for Bessey Bar Clamps Styles 43 and 45 and Gross Stabil Clamp. Publication source and date unknown. It is believed that this publication was available to the public prior to Jul. 15, 1993.

"Pony Clamp Fixtures" styles 50,52,53 and 56. "Jorgensen Style 3500 Aluminum Bar Clamps." "Jorgensen Style 7200 Steel I–Bar Clamps." Publication source and date unknown. It is believed that this publication was available to the public prior to Jul. 15, 1993.

"Catalog—American Tool Companies, Inc.," advertisement of American Tool Companies, Inc., pp. 2–1 through 2–3 and 2–5 through 2–6. It is believed that the catalog was published in Oct. of 1997.

* cited by examiner

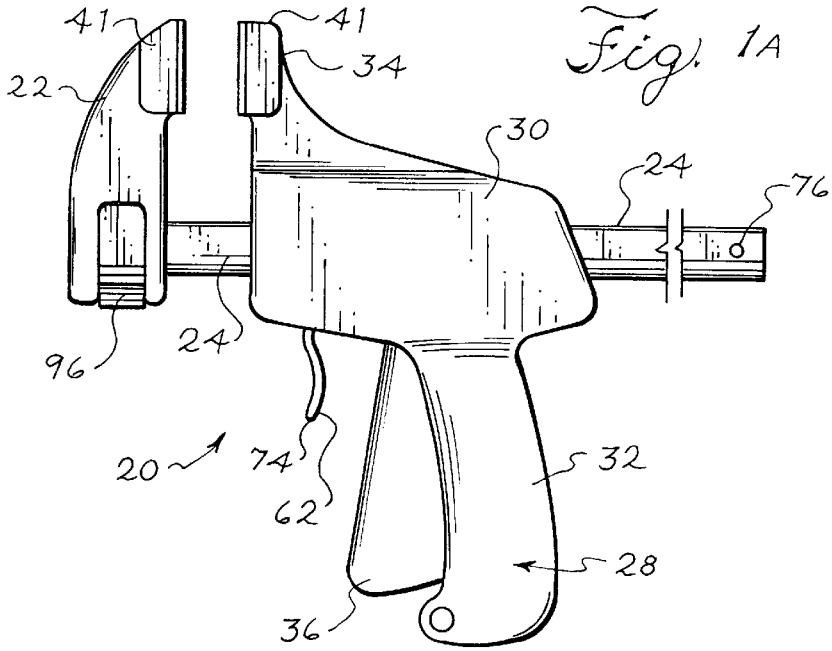
Fig. 1A
Fig. 1B
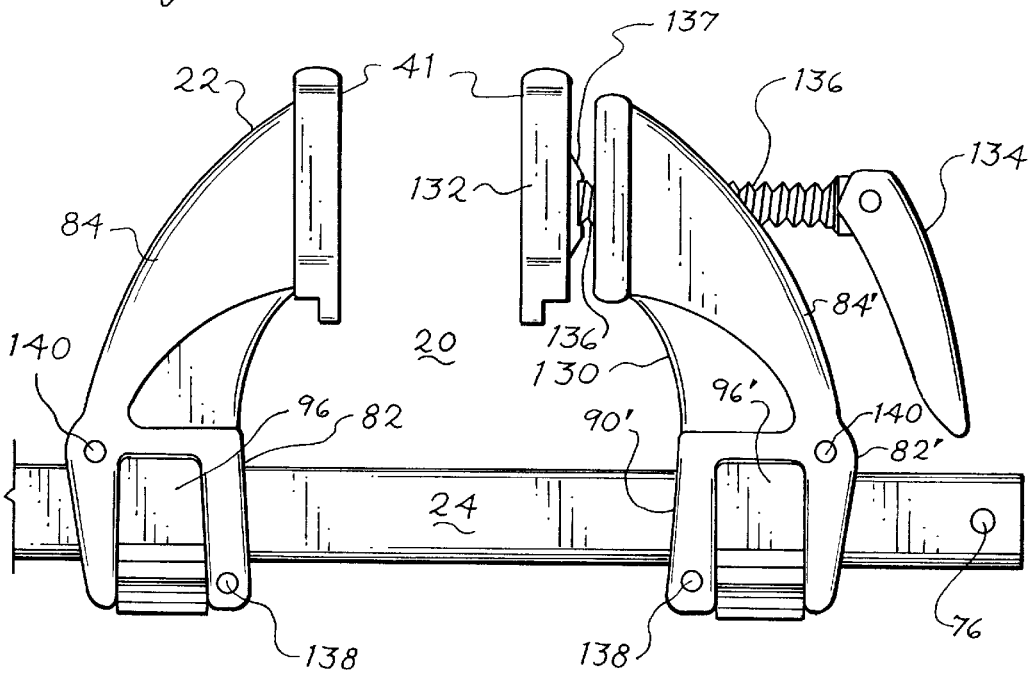

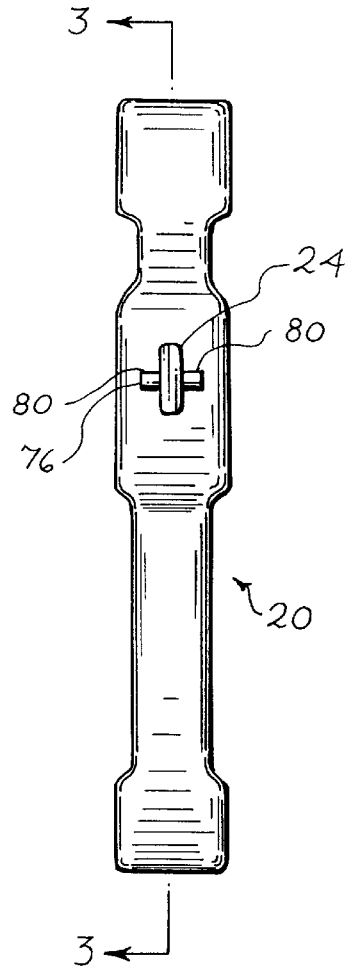
Fig. 2
Fig. 3
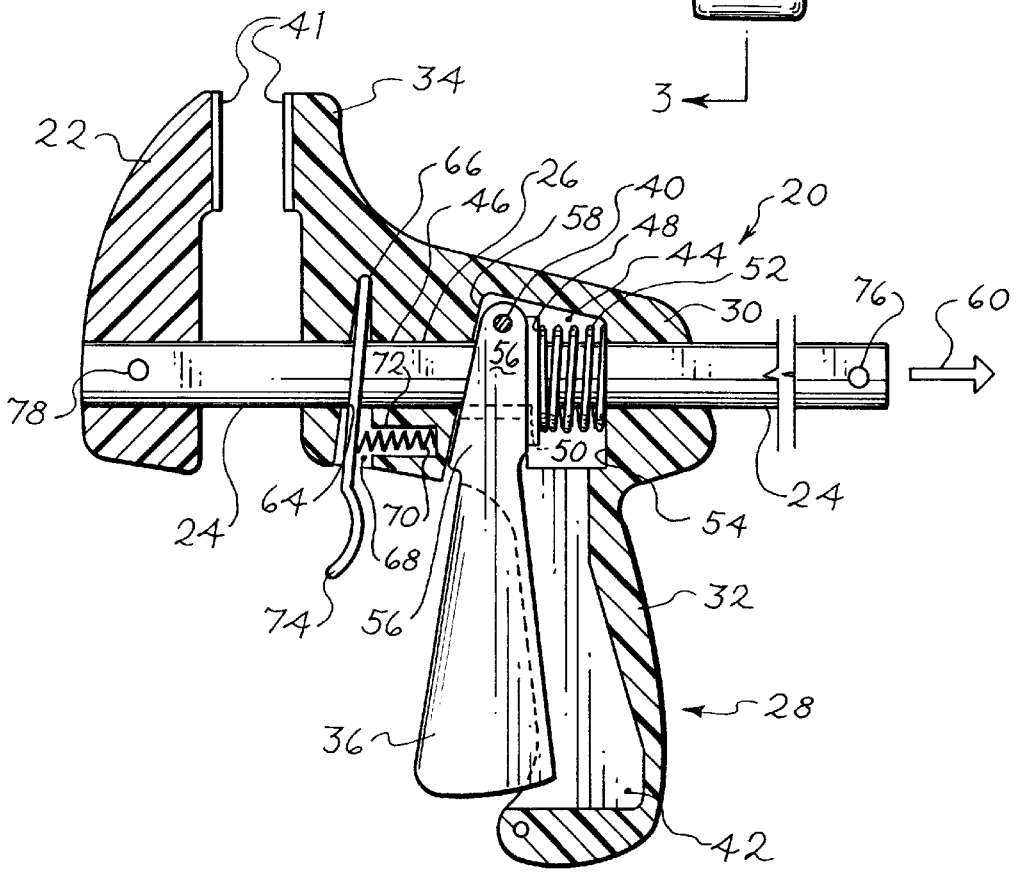

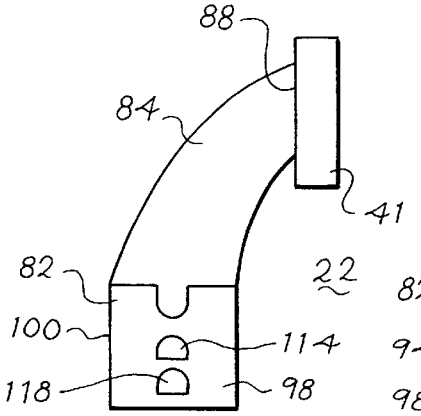
Fig. 4
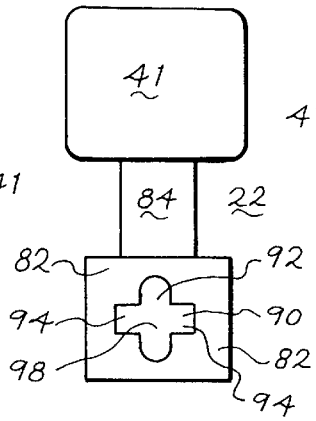
Fig. 6
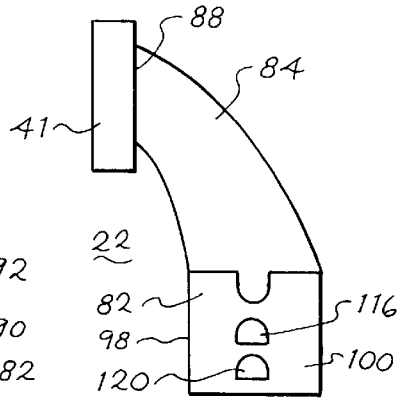
Fig. 5
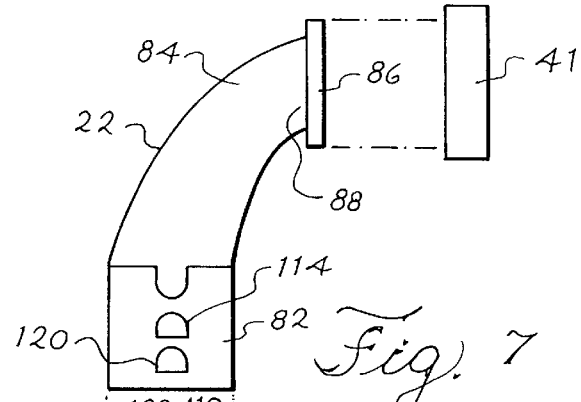
Fig. 7
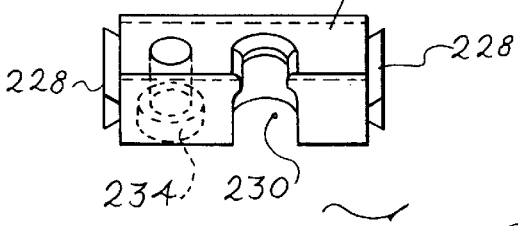
Fig. 21A
Fig. 21B
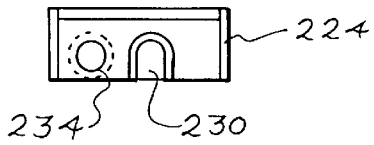
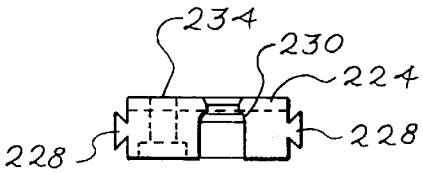
Fig. 21C Fig. 8
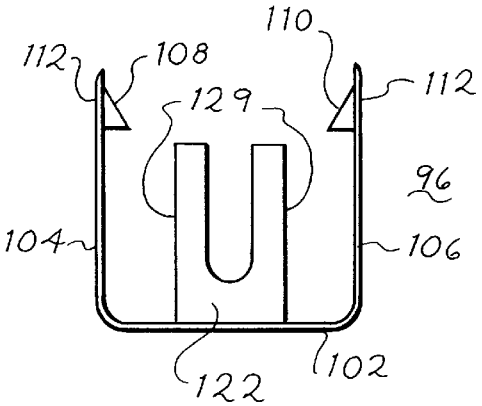
Fig. 9
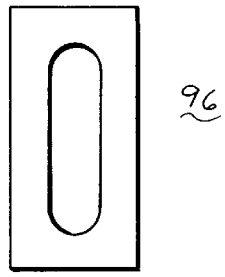
Fig. 11
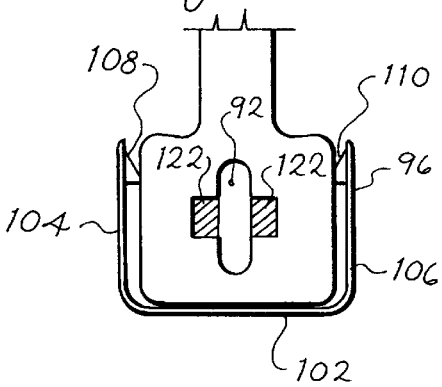
Fig. 10
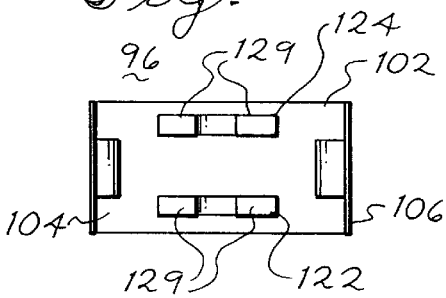
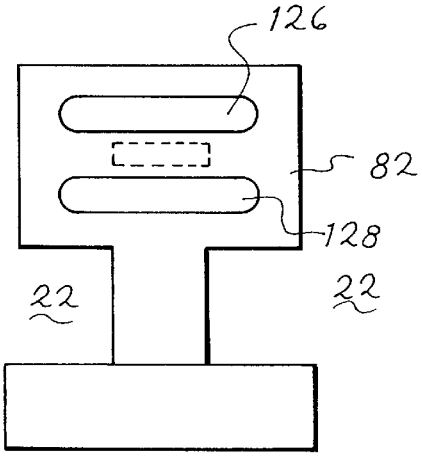
Fig. 12
Fig. 13
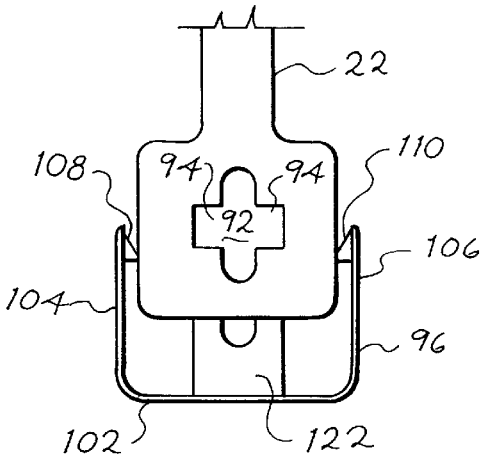

CLAMPING JAW

BACKGROUND OF THE INVENTION

1. Field of the Invention

This invention relates to a method and apparatus for adjusting the orientation of a clamping jaw.

2. Discussion of Related Art

Bar clamps for clamping objects into position are well known in the art. In recent years, advances have been made in bar clamps that enable them to be operated by a single hand. An example of such a bar clamp is disclosed in U.S. Pat. No. 4,926,722 which discloses a trigger mechanism to move a movable clamping jaw toward a fixed clamping jaw. The movable clamping jaw is attached to a moving bar.

Spreading clamps that are operable by a single hand are also well known, such as described in U.S. Pat. No. 5,009,134. Again, the movable jaw is attached to a bar.

SUMMARY OF THE INVENTION

One aspect of the present invention concerns an adjustable clamping jaw supported on a support element having a clamping jaw with a jaw body and a clamping face attached thereto, wherein the jaw body has a first opening to receive the support element. An engagement element is attached to the jaw body and movable relative to the jaw body from a first position to a second position, wherein when the engagement element is located at the first position the jaw body is able to move relative to the support element and when the engagement is located at the second position the jaw body is unable to move relative to the support element.

A second aspect of the present invention regards an adjustable clamping jaw apparatus having a support element with a stop element. A clamping jaw having a jaw body and a clamping face attached thereto, wherein the jaw body has a channel and the stop element is positioned within the channel. An engagement element attached to the jaw body and positioned to block a first end of the channel and a second end of the channel so that the stop element is trapped between the first and second ends of the channel.

A third aspect of the present invention regards a method of attaching a clamping jaw to a support element by inserting the support element into an opening formed in the clamping jaw and moving an engagement element attached to the clamping jaw to a first position where the clamping jaw is able to move relative to the support element. The method including the step of moving the engagement element to a second position so that the jaw body is unable to move relative to the support element.

A fourth aspect of the present invention regards a clamping jaw with a jaw body having a channel formed therein that extends from a first end of the jaw body to a second end of the jaw body. The clamping jaw further includes a clamping face and a rotatable shaft positioned within the channel, wherein a first end of the shaft extends through the first end of the jaw body and is attached to the clamping face. A rotation inhibitor is attached to the clamping face and partially extends into a second channel formed in the jaw body, wherein rotation of the shaft causes said clamping face to translationally move while the rotational inhibitor prevents the clamping face from rotating.

Another aspect of the present invention regards a method of attaching a clamping jaw to a support element comprising a stop element having the steps of positioning a stop element within a channel formed in the clamping jaw and blocking a first end of the channel and a second end of the channel so that the stop element is trapped between the first and second ends of the channel.

Each aspect of the present invention provides the advantage of a clamping jaw that is easily attached to a bar clamp.

One or more aspects of the present invention provides a second advantage of a single bar clamp that is easily converted from a clamping bar clamp to a spreader bar clamp and vice versa.

The foregoing features and advantages of the present invention will be further understood upon consideration of the following detailed description of the invention taken in conjunction with the accompanying drawings, in which:

BRIEF DESCRIPTION OF THE DRAWINGS

FIG. 1A shows a side view of an embodiment of a reversible bar clamp that employs an adjustable clamping jaw according to the present invention;

FIG. 1B shows a side view of a second embodiment of a reversible bar clamp that employs a second embodiment of an adjustable clamping jaw according to the present invention;

FIG. 2 shows a rear view of the reversible bar clamp of FIG. 1A;

FIG. 3 shows an enlarged sectional view of the reversible bar clamp of FIG. 1A taken along the section line 3—3 of FIG. 2;

FIG. 4 shows a right side view of the adjustable clamping jaw of FIGS. 5A–B;

FIG. 5 shows a left side view of the adjustable clamping jaw of FIGS. 1A–B;

FIG. 6 shows a front view of the adjustable clamping jaw of FIGS. 1A–B;

FIG. 7 shows an exploded view of the adjustable clamping jaw of FIGS. 1A–B;

FIG. 8 shows a front view of an embodiment of an engagement element used with the adjustable clamping jaw of FIGS. 1A–B;

FIG. 9 shows a side view of the engagement element of FIG. 8;

FIG. 10 shows a top view of the engagement element of FIG. 8;

FIG. 11 shows a front view of the adjustable clamping jaw of FIGS. 1A–B where the engagement element of FIG. 8 is positioned at an engagement position;

FIG. 12 shows a bottom view of the adjustable clamping jaw of FIG. 11;

FIG. 13 shows a front view of the adjustable clamping jaw of FIGS. 1A–B where the adjustable element of FIG. 8 is positioned at a disengagement position;

FIG. 21A is a perspective view of a body to be used with the reversible bar clamp of FIG. 20;

FIG. 21B is a top view of the body of FIG. 21A;

FIG. 21C is a front view of the body of FIG. 21A;

DESCRIPTION OF THE PREFERRED EMBODIMENT

Figures 14, 22A, 22B, 22C, 22D:
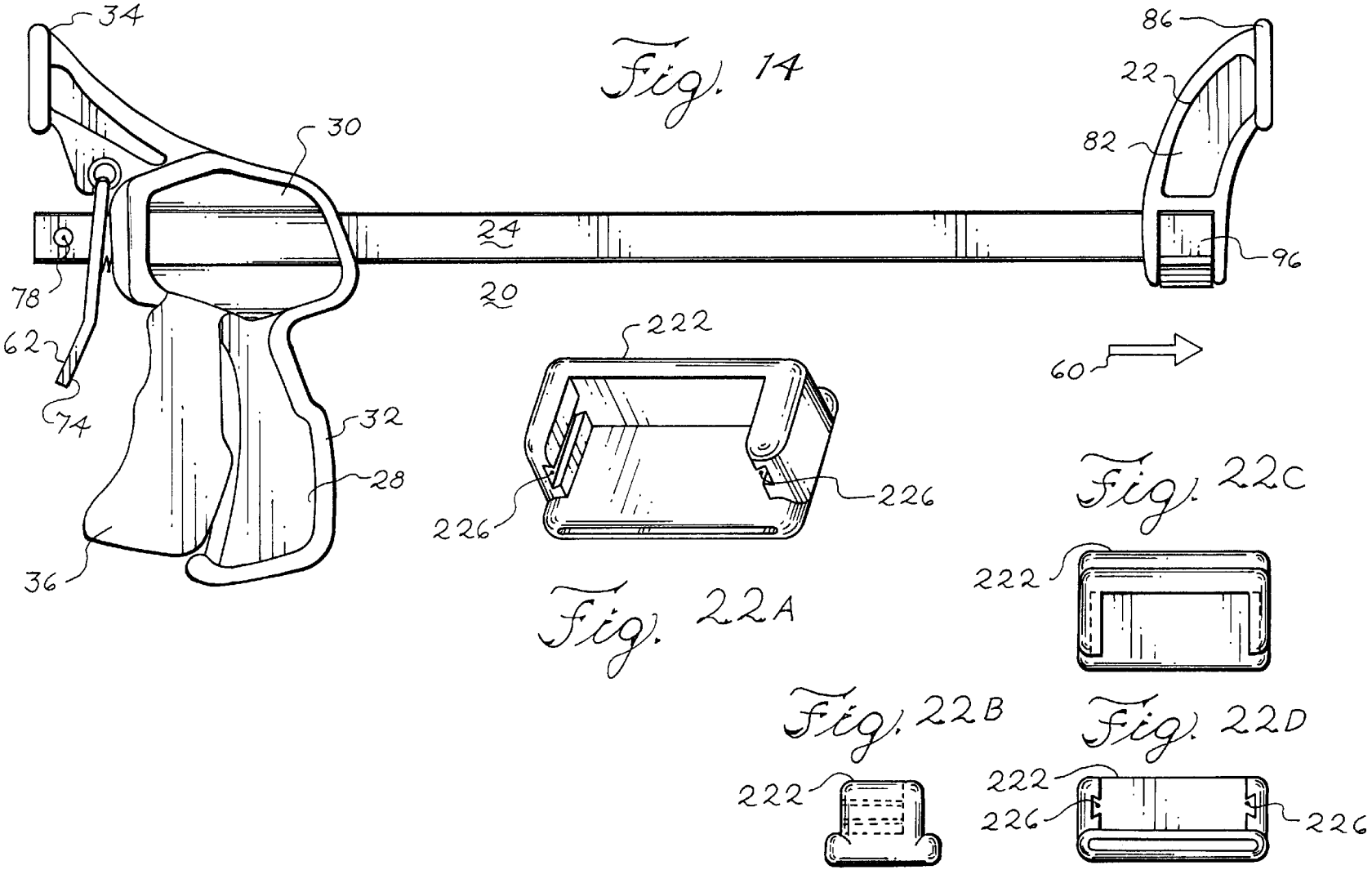
FIG. 14 shows the reversible bar clamp of FIG. 1A when the adjustable clamp is reversed so that a spreading clamp is formed.
FIG. 22A is a perspective view of an exterior housing to be used with the reversible bar clamp of FIG. 20.
FIG. 22B is a left side view of the exterior housing of FIG. 22A.
FIG. 22C is a top view of the exterior housing of FIG. 22A.
FIG. 22D is a front view of the exterior housing of FIG. 22A.

Referring now to the drawings wherein like reference characters designate identical or corresponding parts throughout the several figures, and in particular FIGS. 1A, 2 and 3 show a reversible bar clamp 20. The reversible bar clamp 20 includes a movable and adjustable clamping jaw 22 connected to a support element, such as a rod or a bar 24. The bar 24 is slidably supported in a slot 26 which passes through a handle/grip assembly 28. The handle/grip assembly 28 includes a clam body 30 through which the slot 26 passes, a handle grip 32 attached to the clamp body 30 on one side of the slot 26, and a fixed jaw 34 attached to the clamp body 30 on the other side of the slot 26. A trigger handle 36 is pivotably mounted to the body 30 adjacent the slot 26 by means of a pivot pin 40. Note that protective pads 41 may be attached to the jaws 22 and 34.

As shown in FIG. 3, the handle grip 32 is hollow in part so as to receive the trigger handle 36 in the cavity 42. A second cavity 44 in the clamp body 30 divides the bore 46. A driving lever 48 is suspended on the bar 24 which passes through a hole 50 in the driving lever 48. A spring 52 is compressed between the driving lever 48 and a surface 54 of the cavity 44 urging the driving lever 48 against the upper end 56 of the trigger handle 36. The upper end 56 of the trigger handle 36 is forked and straddles the bar 24. The force of the spring 52 urges the trigger handle 36 against an inner surface 58 of the clamp body 30 thus providing a standby condition. In the standby condition, the driving lever 48 is positioned perpendicular to the direction of motion, indicated by the arrow 60, of the bar 24 when in operation. Any motion of the trigger handle 36 about the pivot pin 40 in the direction of the arrow 60 is accomplished against the bias of the spring 52.

A braking lever 62 is suspended from the bar 24 which passes through an opening 64 in the braking lever 62. One end 66 of the braking lever 62 is pivotably captured in a recess 68 within the clamp body 30 such that the braking lever 62 may pivot within constraints defined by the surfaces of the recess 68 and by binding the braking lever 62 with the bar 24 when the edges of the opening 64 in the braking lever 62 engage the surface of the bar 24. A spring 70 sits in a recess 72 in the clamp body 30 and biases the free end 74 of the braking lever 62 away from the trigger handle 36. The biased position of the braking lever 62 is limited by the binding interference between the opening 64 of the braking lever 62 with the bar 24.

If a force is applied to the movable jaw 22 of FIG. 3 in the direction indicated by the arrow 60, the bar 24 is free to move through the hole 50 in the driving lever 48 and through the spring 52. Because the braking lever 62 is free to pivot against the bias of the spring 70 when force is applied on the movable jaw 22 in the direction of the arrow 60, the braking lever 62 presents no obstacle to this motion of the bar 24 and the movable jaw 22 may be advanced continuously toward the fixed jaw 34. Incremental motion of the bar 24 and the attached movable jaw 22 toward the fixed jaw 34 is also possible by squeezing the trigger handle 36 one or more times in the direction indicated by the arrow 60.

Note that when the braking lever 62 and the trigger handle 36 are not manually engaged and a force is applied to the movable jaw 22 of FIG. 3 in the direction opposite to the direction indicated by the arrow 60, the edges of the opening 64 in the braking lever 62 bind against the surface of the bar 24 and it is not possible, without further action, to withdraw the movable jaw 22 further away from the fixed jaw 34. Compression of the spring 70 by pressing on the braking lever 62 in the direction of the arrow 60, allows withdrawal of the bar 24 and movable jaw 22 away from the fixed jaw 34. This force results in the end 66 of the braking lever 62 being perpendicular with the direction of intended motion of the bar 24. Then the bar 24 is free to slide in either direction through the opening 64 in the braking lever 62. Note that the bar 24 has a rectangular cross-section. Of course, the bar 24 may have other cross-sectional shapes, such as a square, a circle, or a triangle. The openings 50 and 64 are shaped to accommodate the cross-sectional shape of the bar 24 to provide proper binding interference with the bar 24.

Examples of structures for moving the bar 24 are disclosed in U.S. Pat. No. 4,926,722, whose entire contents are incorporated herein by reference, and a bar clamp manufactured by Petersen Manufacturing Co., Inc. of DeWitt, Nebr. under the trademark QUICK-GRIP.

The bar 24 has a pair of circular openings formed at either end. Cylindrical stop elements 76 and 78 are inserted into and attached within the circular openings so that the stop elements 76 and 78 extend substantially perpendicular to the longitudinal axis of the bar 24. The stop elements 76 and 78 may be removably attached to the openings in a well known manner, such as by an interference fit. In such a case, the stop elements 76, 78 are wedged into the circular opening.

As the movable jaw 22 is moved away from the fixed jaw 34, the stop element 76 nears the rear of the slot 26. Upon reaching the rear of the slot 26, the ends 80 of the stop element 76 contact the fixed jaw 34 outside of the slot 26. Thus, the stop element 76 prevents the movable jaw 22 from moving further away from the fixed jaw 34.

The other end of the bar 24 supports an adjustable clamping jaw 22. As shown in FIGS. 4–5 and 7, the adjustable clamping jaw 22 includes a jaw body 82, a curved stem 84 integrally attached to the top of the jaw body 82 and a clamping face 86 integrally attached to a free end 88 of the curved stem 84. The jaw body 82 preferably is box-like in shape having a height of approximately 1.5", a length of approximately 1.5", and a width of approximately 1.25".

As shown in FIGS. 6 and 13, the jaw body 82 has an opening or channel 90 that extends through the entire length of the jaw body 82. The channel 90 has across-sectional shape that is generally shaped in the shape of a cross having a central vertical area 92 shaped to receive the bar 24 and a pair of adjacent areas 94 that receive corresponding ends 80 of the stop element 78. The jaw body 82 is attached to the rod or bar 24 by inserting the bar 24 through the vertical area 92 along a longitudinal axis of the channel 90. The ends 80 of the stop element 78 that extend substantially perpendicular to the longitudinal axis of the channel 90 are inserted through the adjacent areas 94 and placed midway within the channel 90. The adjustable clamping jaw 22 is attached to the bar 24 by moving an engagement element 96 from the disengagement position shown in FIG. 13 to the engagement position shown in FIG. 11. At the engagement position, the engagement element 96 blocks both ends 98, 100 of the channel 90 so that the stop element 78 is trapped between the ends 98, 100 of the channel 90 by the engagement element 96 and is prevented from being removed from the channel 90. Thus, the jaw body 82 is unable to move relative to the bar 24 resulting in the clamping jaw 22 being effectively attached to the bar 24. The clamping jaw 22 is unattached to the bar 24 by moving the engagement element 96 to the disengagement position of FIG. 13 where the engagement element 96 is absent from blocking the channel 90 so that the jaw body 82 and the clamping jaw 22 are able to move relative to the bar 24 so that the stop element 78 is removed from the channel 90. Reattachment is accomplished by reversing the above-mentioned steps and inserting the stop element 78 into the channel 90 and moving the engagement element 96 to the engagement position of FIG. 11.

As shown in FIGS. 8 and 10, the engagement element 96 has a rectangular base 102 with a pair of legs 104, 106 integrally attached to the base 102. Each leg 104 and 106 is rectangular in shape and has a corresponding triangular wedge 108 and 110, respectively, integrally attached to the free end 112 of the leg. The base 102 and legs 104 and 106 form a U-shaped engagement element 96 that is designed to be attached to the jaw body 82 by having the legs 104 and 106 engage the exterior surface of the jaw body 82 as shown in FIGS. 11 and 13. The legs 104 and 106 are spread a sufficient distance apart so that the jaw body 82 can fit therebetween.

The legs 104 and 106 are preferably parallel to one another or may be slightly angled towards each other to ensure that the wedges 108 and 110 maintain contact with the exterior surface of the jaw body 82 when moving form the disengagement position of FIG. 13 to the engagement position of FIG. 11 and vice versa. At the engagement position, each wedge 108 and 110 engages a corresponding upper indent 114 and 116, respectively, formed in the exterior surface of the jaw body 82. Similarly, the jaw body 82 has a pair of lower indents 118 and 120 that are engaged by the wedges 108 and 110, respectively, when the engagement element 96 is at the disengagement position shown in FIG. 13. The indents 114, 116, 118 and 120 perform two functions. First, they make it more difficult to move the engagement element 96 from the engagement or disengagement positions because the wedges 108 and 110 are partially encompassed by the indents. The indents also perform a signaling function. The user can feel or sense when the wedges 108 and 110 are inserted within the indents and so the user knows that further movement of the engagement element 96 is unnecessary.

Besides attaching the two legs 104 and 106 together, the base 102 acts as a support for a pair of blockers 122 and 124 that are shown in FIGS. 8 and 10. Each blocker 122 and 124 is preferably U-shaped, have an identical shape and are spaced parallel to one another.

As shown in FIG. 12, the underside of the jaw body 82 has a pair of rectangular-like slots 126 and 128 that extend from the bottom of the jaw body 82 and intersect through the channel 90. The width and the length of the slots 126 and 128 is such that the blockers 122 and 124 can be inserted within the slots 126 and 128, respectively. As shown in FIG. 13, the blockers 122 and 124 are absent from the channel 90 when the wedges 108 and 110 engage the lower indents 118 and 120, respectively, when the engagement element 96 is moved to the disengagement position. At this stage, the stop element 78 is inserted into the center of the channel 90. Note that the stop element 78 can be inserted through either the end 98 or through the end 100. When the stop element 78 is inserted through the end 98, the clamp face 86 faces towards the fixed jaw 34 so that the bar clamp 20 acts a compressing clamp. As explained in more detail below, when the stop element 76 enters the end 100, the clamp face 86 faces away from the fixed jaw 34 so that the bar clamp 20 can be converted into a spreading device as shown in FIG. 14.

After the stop element 78 is inserted within channel 90, the engagement element 96 is moved upwards so that the wedges 108 and 110 engage the upper indents 114 and 116, respectively, and the blockers 122 and 124 block the channel 90. The channel 90 is blocked by having the blocker 122 partially block the end 98 of the channel 90 and the blocker 124 partially block the end 100 of the channel 90. In particular, each of the legs 129 of the U-shaped blockers 122 and 124 block the adjacent areas 94 of the channel 90 while the central vertical area 92 of the channel 90 is unimpeded. The blockers 122 and 124 are separated from one another by an amount that is approximately equal to the thickness of the stop element 78. The separation distance is such that the blockers 122 and 124 will be positioned adjacent to and on either side of the stop element 78 so that the stop element 78 is trapped between the blockers 122 and 124 so that the movable jaw 22 is unable to move relative to the bar or rod 24. Note that the engagement element 96 has a symmetric shape about a plane that is parallel to and lies halfway between the blockers 122 and 124 so that the engagement element 96 can be rotated by 180 degrees and still be able to function as described above.

If it is desired to convert the bar clamp 20 into a spreading device, the engagement element 96 is lowered to the disengagement position shown in FIG. 13 so as to unblock both ends 98 and 100 of the channel 90. The stop element 78 is then removed from the end 98 of the channel 90 where it was originally inserted. The jaw body 82 is rotated by 180° and positioned at the other stop element 76 so that the end 100 of the channel 90 is facing the stop element 76. The stop element 76 is then inserted into the center of the channel 90 and the engagement element 96 is moved to the engagement position to lock the movable jaw 22. The fixed jaw 34 and the movable jaw are facing away from each other as shown in FIG. 14. When the trigger handle 36 is squeezed, the movable jaw 22 moves away from fixed jaw 34. The stop element 78 prevents withdrawal of the bar 24 from the slot 26 when the braking lever 62 is pressed in the direction of the arrow 60 and the movable jaw 22 is manually drawn away from the fixed jaw 34.

Examples of structures for moving the bar 24 in a spreading manner are disclosed in U.S. Pat. No. 5,009,134, whose entire contents are incorporated herein by reference, and a spreading bar clamp manufactured by Petersen Manufacturing Co., Inc. of DeWitt, Nebr. under the trademark QUICK-GRIP.

Figure 16:
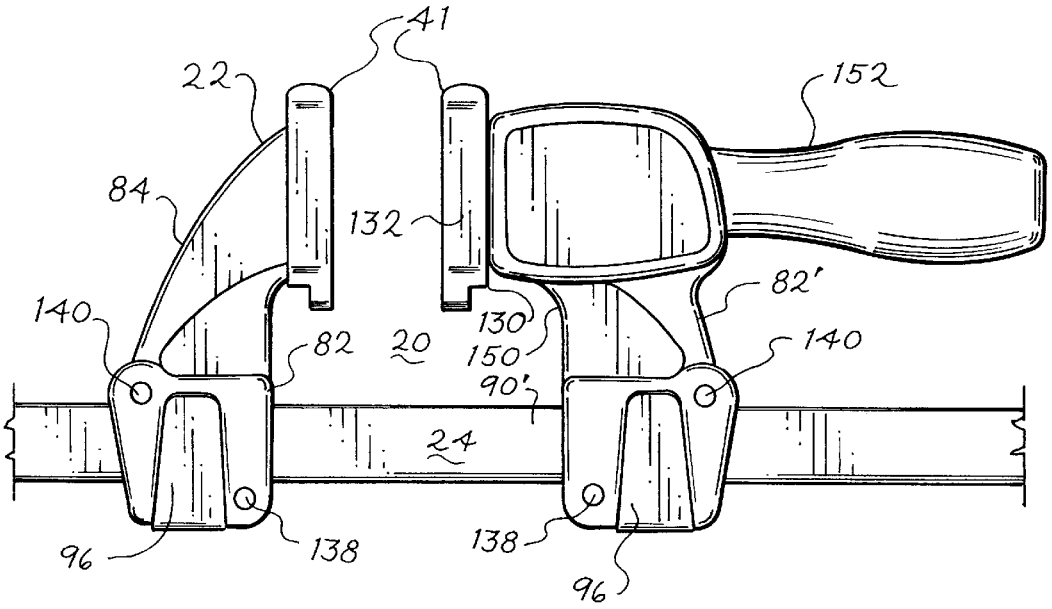
FIG. 16 shows a side view of a third embodiment of a reversible bar clamp that employs a third embodiment of an adjustable clamping jaw according to the present invention.

Second and third embodiments of a bar clamp 20 are shown in FIGS. 1B and 16–17. The bar clamp 20 employs a bar 24 as described above with respect to the bar clamp 20 of FIG. 1A. The bar clamp 20 includes a movable clamping jaw 22 that is attached via engagement element 96 to the bar by a stop element 78 (not shown) in the same manner as with the bar clamp of FIG. 1A.

The adjustable clamping jaw 22 includes an engagement element 96 that attaches the jaw 22 to the stop element 76 or 78 in the same manner as described above. The adjustable clamping jaw 22 and engagement element 96 have a structure and operate as described above with respect to the clamping jaw 22 and engagement element 96 of FIGS. 4–13.

In the embodiment of FIG. 1B, a second adjustable and movable clamping jaw 130 is slidingly attached to the bar 24. The second clamping jaw 130 has a structure that is similar to that of the clamping jaw 22. The second clamping jaw 130 is slid onto the bar 24 by moving its engagement element 96' to the disengagement position and inserting the stop element 76 and a portion of the bar 24 into one end of the channel 90' at one side of the jaw body 82' and out the other end of the channel 90' at an opposing side of the jaw body 82'. When the clamping jaw 130 is positioned between the clamping jaw 22 and the stop element 76, the engagement element 96' is then moved to the engagement position so that the clamping jaw 130 is only allowed to slide along the bar 24 from the stop element 76 to the clamping jaw 22. Note that the engagement element 96 located at the engagement position acts like a bumper when the engagement element 96 is slid toward the stop element 76. The engagement element 96 will contact or bump the stop element 76 and will be prevented from moving any nearer the stop element 76. Stated in another way, the stop element 76 and the portion of the bar 24 inserted through the channel 90' are prevented from reentering the channel 90' when the engagement element 96' is moved to the engagement position.

Clamping an object with the bar clamp 20 of FIG. 1B is accomplished by placing the object between the clamping jaws 22 and 130 and adjacent to the clamping jaw 22. Clamping jaw 130 is then slid towards the object until the clamping face 132 touches or is adjacent to the object. Next, a handle 134 is rotated which causes a screw 136 to rotate resulting in the clamping face 132 to press against the object. A annular bracket 137 is attached to both the distal end of the screw 136 and the clamping face 132. The handle 134 is pivotably attached to the screw 136 by well known means such as a pin.

Figure 15:
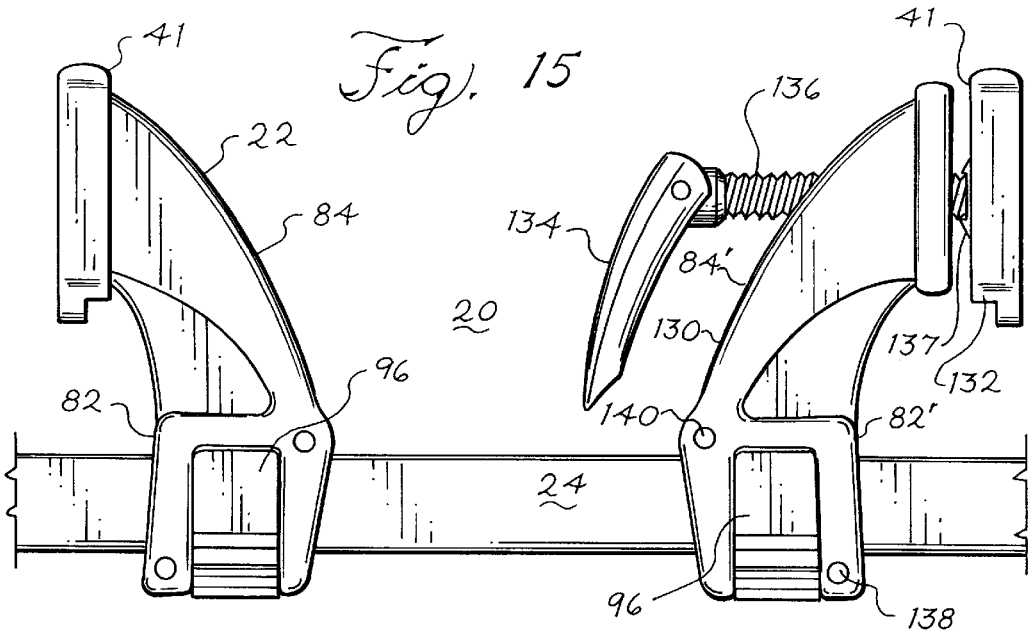
FIG. 15 shows the reversible bar clamp of FIG. 1B when the adjustable clamp is reversed so that a spreading clamp is formed.

While the clamping face 132 is pressed against the object, a lower locking pin 138 and an upper locking pin 140 together lock the clamping jaw 130 into position. The locking pins 138 and 140 are inserted though the jaw body 82' of the clamping jaw 130 so that they are adjacent to opposite sides of the bar 24 and separated from one another along a diagonal. During the pressing of the clamping face 132, the lower and upper locking pins 138 and 140 are rotated clockwise as shown in FIG. 1B. The lower and upper locking pins 138 and 140 then engage both sides of the bar 24 and, thus the clamping jaw 130 is locked into position. An example of the structure and use of the locking pins 138 and 140 is disclosed in U.S. patent application Ser. No. 08/344,852, whose entire contents are incorporated herein by reference. Note that it is also possible to convert the bar clamp of FIG. 1B to a spreading clamp by removing the clamping jaws 22 and 130, reversing them and reattaching them to the bar 24 as shown in FIG. 15.

Figure 17A:
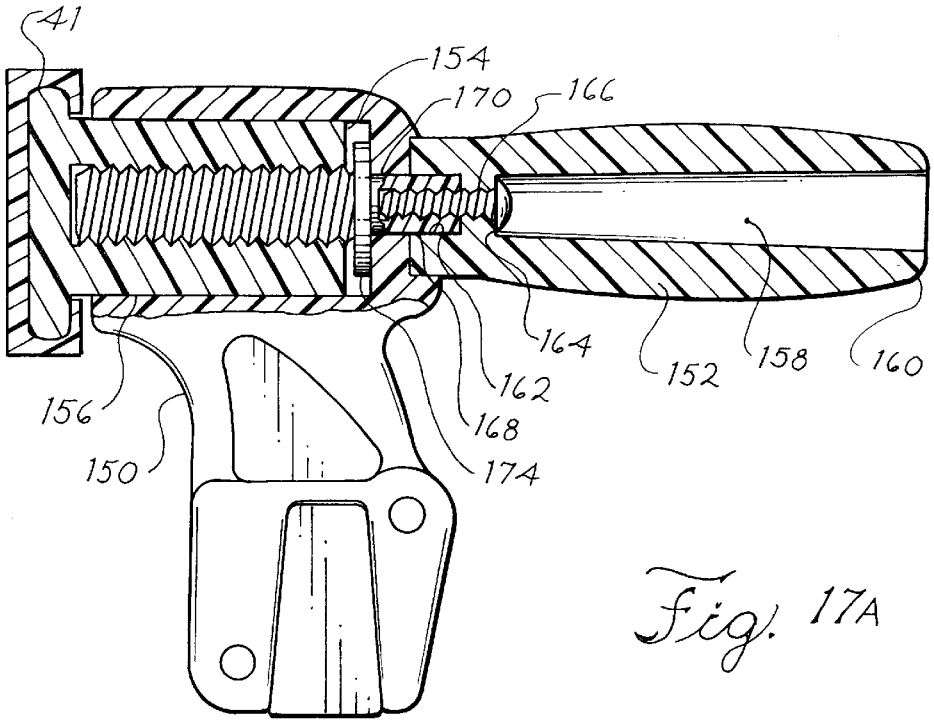
FIG. 17A shows a side cross-sectional view of the reversible bar clamp of FIG. 16 when in a retracted position.
Figure 17B:
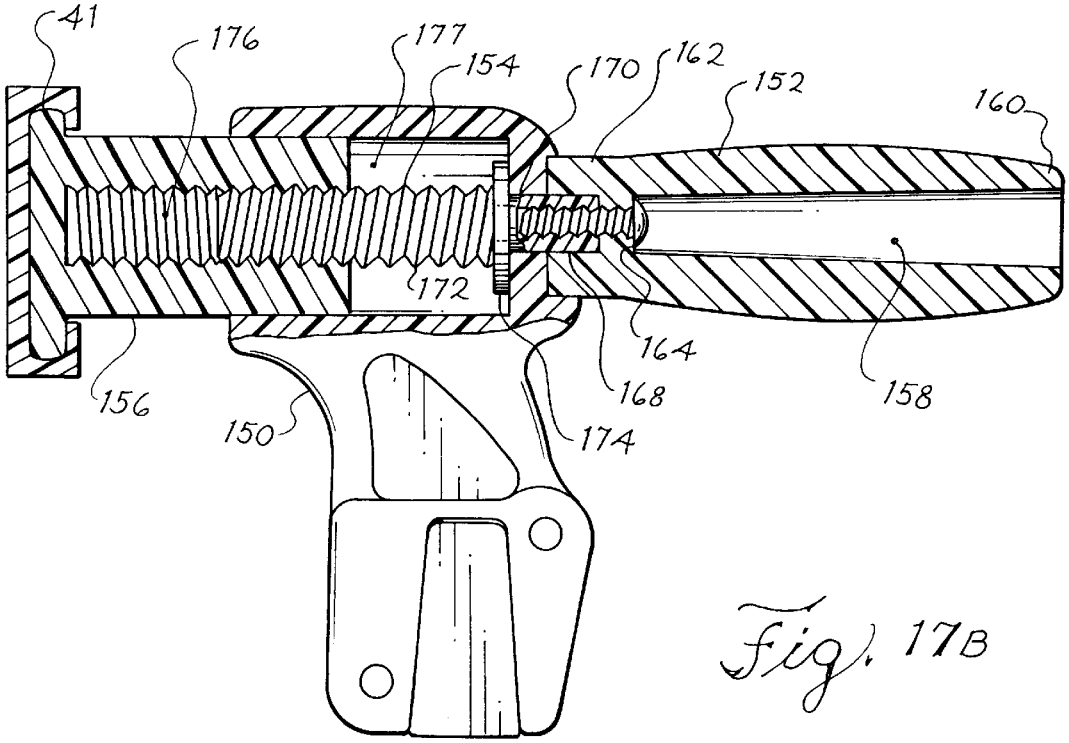
FIG. 17B shows a side cross-sectional view of the reversible bar clamp of FIG. 16 when in an expanded position.

In the embodiment of the bar clamp 20 of FIGS. 16 and 17A–B, a second adjustable and movable clamping jaw 150 is slidingly attached to the bar 24. The second clamping jaw 150 is slid onto the bar 24 by moving its engagement element 96' to the disengagement position and inserting the stop element 76 into one end of the channel 90' of the jaw body 82' and out the other end of the channel 90'. When the clamping jaw 150 is positioned between the clamping jaw 22 and the stop element 76, the engagement element 96' is then moved to the engagement position so that the clamping jaw 130 is only allowed to slide along the bar 24 from the stop element 76 to the clamping jaw 22. As with the embodiment of FIG. 1B, the engagement element 96' acts like a bumper when it contacts or bumps the stop element 76 and prevents the clamping jaw 150 from moving any nearer the stop element 76.

Clamping an object is accomplished by placing the object between the clamping jaws 22 and 150. The object is placed adjacent to the clamping jaw 22 and the clamping jaw 150 is then slid towards the object until clamping face 132 touches or is adjacent to the object. Next, a handle 152 is rotated which causes a screw 154 to rotate which in turn causes a movable shaft 156 to translationally move so that the pad 41 attached to the shaft 156 presses against the object.

As shown in FIGS. 17A–B, the handle 152 defines a cylindrical opening 158 having a diameter of approximately 0.5" and that extends approximately 3" from the distal end 160 of the handle 152 towards the other end 162 of the handle 152. At the closed end 164 of the opening 158, a screw 166 is inserted therethrough so as to threadedly engage a female receiving member 168 of the screw 154. The female receiving member has a diameter of approximately ⅜ and a length of approximately 0.5" so that it extends through a circular opening 170 formed in the clamping jaw 150. The female receiving member 168 is integrally connected with a threaded portion 172 of the screw 154 that has approximately 18 threads at a pitch of approximately 15 degrees. The threads extend 360 degrees about the screw 154. An annular washer 174 is slipped onto the exterior surface of the female receiving member 168 so that it prevents the screw 154 from translationally moving relative to the clamping jaw 150 when the handle 152 is rotated.

The screw 154 threadedly engages threads within an interior portion 176 of the movable shaft 156. The interior portion 176 may be cylindrical in shape with threads that circumscribe an arc of 360 degrees or it may be half-cylindrical or U-shaped with threads that circumscribe an arc of 180 degrees. In both cases of a cylindrical and a half-cylindrical interior portion 176, the threads of the screw 154 extend 360 degrees about the screw 154.

As mentioned above, rotation of the handle 152 in one sense causes the screw 154 to rotate. Since the screw 154 is prevented from translational movement, rotation of the screw 154 causes the shaft 156 to translationally move within the 1⅛" diameter cylindrical cavity 177 from the ret position as shown in FIG. 17B. Rotation of the handle 152 in the opposite sense will cause the shaft 156 to translationally move from the extended position of FIG. 17B towards the retracted position of FIG. 17A. It should be noted that the cross-sections of the movable shaft 156 and cavity 177 may have various shapes, such as being rectangular, with the proviso that the movable shaft 156 snugly fits with the cavity 177.

As with the clamping jaw of FIG. 1B, when the clamping face 132 is pressed against the object, a lower locking pin 138 and an upper locking pin 140 rotate clockwise and engage both sides of the bar 24 so as to lock the clamping jaw 150 into position. The locking pins 138 and 140 are inserted through the jaw body 82' of the clamping jaw 150 so that they are adjacent to opposite sides of the bar 24 and separated from one another along a diagonal.

Note that it is also possible to convert the bar clamp of FIG. 16 to a spreading clamp by removing the clamping jaws 22 and 150, reversing them and reattaching them to the bar 24 in a manner similar to that shown in FIG. 15 for the bar clamp of FIG. 1A.

Figure 20:
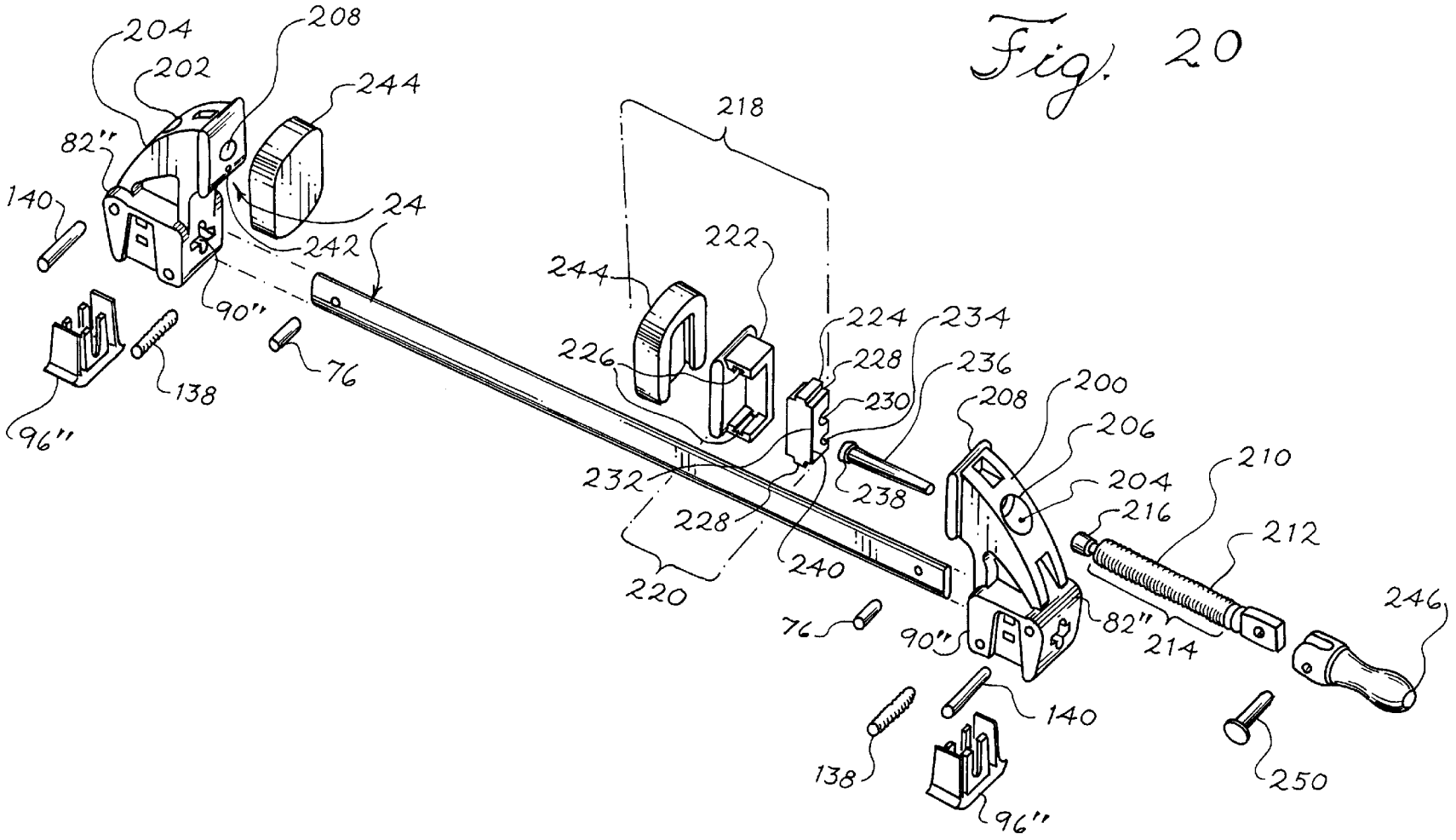
FIG. 20 shows a sixth embodiment of a reversible bar clamp that employs a fourth embodiment of an adjustable clamping jaw according to the present invention.

Another embodiment of a bar clamp is shown in FIG. 20. An adjustable and movable clamping jaw 200 is slidingly attached to the bar 24. The clamping jaw 200 is slid onto the bar 24 by moving its engagement element 96" to the disengagement position and inserting the stop element 76 and a portion of the bar 24 into one end of the channel 90" at one side of the jaw body 82" and out the other end of the channel 90" at an opposing side of the jaw body 82". When the clamping jaw 200 is positioned between the other clamping jaw 202 and the stop element 76, the engagement element 96" is then moved to the engagement position so that the clamping jaw 200 is only allowed to slide along the bar 24 from the stop element 76 to the other clamping jaw 202. Note that the engagement element 96" located at the engagement position acts like a bumper in the same manner as described with respect to the engagement element 96' of FIG. 1B.

As shown in FIG. 20, the jaw body 82" has a channel 204 formed therein that extends from a rear end 206 to a front end 208. The channel 204 is threaded and has a diameter of approximately ½" and a length of approximately 1⅜". A rotatable shaft 210 is positioned within the channel 204 so that the threads 212 in the central portion 214 engage the threads of the channel 204. The front end of the shaft 210 has an annular notch 216 that is attached to the clamping face 218 via a bracket 220. The bracket 220 is made of two parts: an exterior housing 222 (see FIGS. 22A–D) and a body 224 (see FIGS. 21A–C). The exterior housing 222 has a pair of rectangular or beveled grooves 226 that receive corresponding rectangular or beveled flanges 228 formed in the body 224 so that the body 224 slides into the exterior housing 222. Prior to the body 224 being slid into the exterior housing 222, the front end of the shaft 210 is inserted into a top opening 230 so that the U-shaped ledge 232 is inserted into the notch 216. The body 224 has a bottom opening 234 into which a rotation inhibitor, like pin 236, is inserted. The pin 236 has an annular top piece 238 that is inserted into the opening 234 so that the top piece 238 engages underneath the U-shaped bottom ledge 240. The pin 236 partially extends into a second channel 242 formed in the jaw body 82".

The second clamping jaw 202 essentially the same structure as the clamping jaw 200 except the two part bracket 220 and the shaft 210 are removed and the clamping face 244 is slid onto the clamping jaw 202 in a well known manner. The second clamping jaw 202 is slid onto the bar 24 by moving its engagement element 96" to the disengagement position and inserting the stop element 76 into one end of the channel 90" of the jaw body 82" and out the other end of the channel 90". When the clamping jaw 202 is positioned between the clamping jaw 200 and the stop element 76, the engagement element 96" is then moved to the engagement position so that the clamping jaw 202 is only allowed to slide along the bar 24 from the stop element 76 to the clamping jaw 200.

Clamping an object with the bar clamp 20 of FIG. 20 is accomplished by placing the object between the clamping jaws 200 and 202 and adjacent to the clamping jaw 202. Clamping jaw 200 is then slid towards the object until the clamping face 218 touches or is adjacent to the object. Next, a handle 246 attached to the shaft 210 via pin 250 is rotated which causes the threads 212 and the shaft 210 rotate resulting in the clamping face 218 to translationally move and press against the object. During the translational movement of the clamping face 218, the pin 236 slides within the channel 242 and prevents the clamping face 218 from rotating.

While the clamping face 218 is pressed against the object, a lower locking pin 138 and an upper locking pin 140 together lock the clamping jaw 200 into position. The locking pins 138 and 140 are inserted through the jaw body 82" of the clamping jaw 200 so that they are adjacent to opposite sides of the bar 24 and separated from one another along a diagonal. During the pressing of the clamping face 132, the lower and upper locking pins 138 and 140 operate in the same manner as described previously with respect to the pins 138 and 140 of FIG. 1B.

Figure 18:
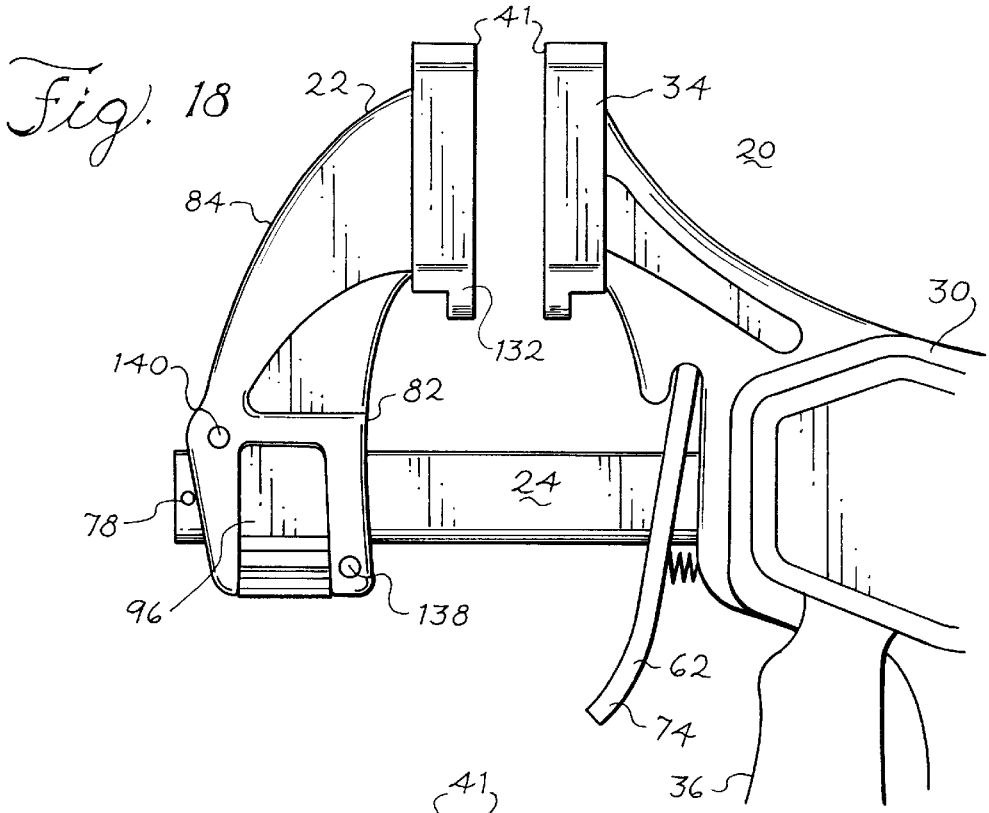
FIG. 18 shows a fourth embodiment of a reversible bar clamp that employs the adjustable clamping jaws of FIGS. 1A–B, 16 and 17A–B.
Figure 19:
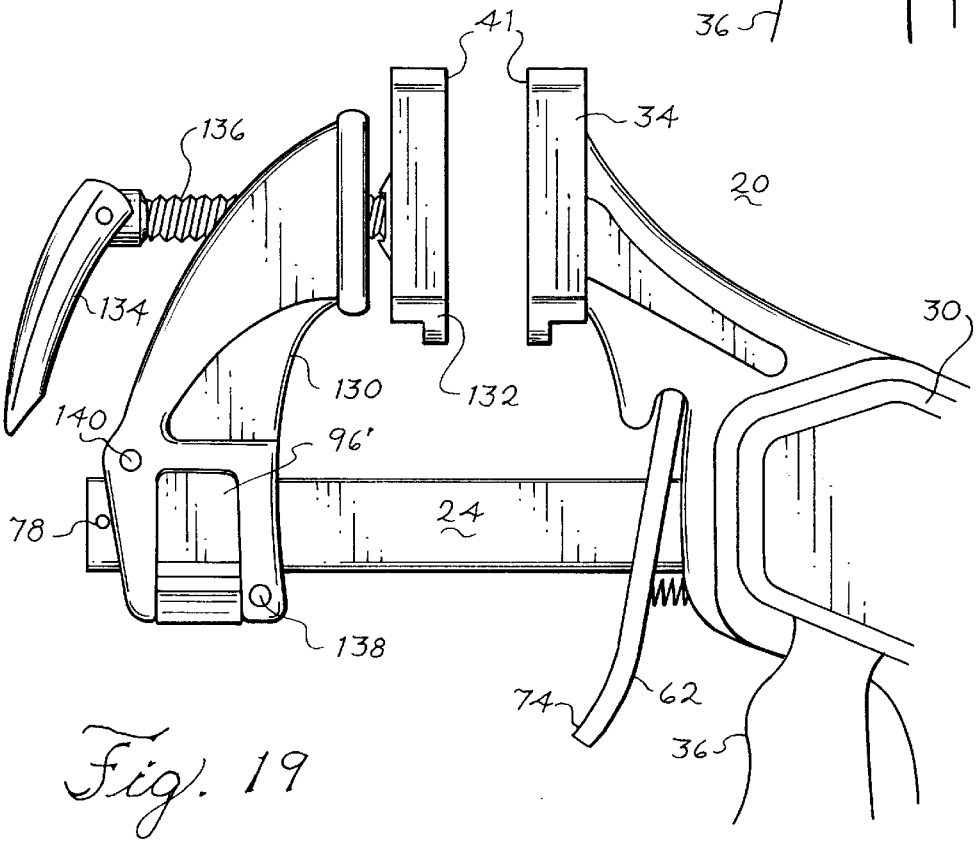
FIG. 19 shows a fifth embodiment of a reversible bar clamp that employs the adjustable clamping jaws of FIG. 15.

Many possible variations for the bar clamps of FIGS. 1A–B, 16, 17A–B and 20 are possible. For example, the lower and upper locking pins 138 and 140 may be attached to the clamping jaws 22 and 202 of the bar clamps of FIGS. 1A–B, 16–17 and 20 in a manner similar to that of the clamping jaw 130. This allows the clamping jaws 22, 202 to be moved along the bar 24 instead of being attached to a stop element. In this case, the locking pins 138 and 140 of the clamping jaws 22, 202 will rotate counterclockwise as shown in FIGS. 1B, 18 and 20. In another embodiment shown in FIG. 19, the clamping jaw 130 of FIG. 1B, with or without locking pins 138 and 140, is slidingly mounted to the bar 24 of FIG. 1A.

It is also possible to use a wide variety of materials for the bar clamps of FIGS. 1A–B, 16, 17A–B and 20. For example, bar 24 may be made of heat treated steel and the jaws 22, 34, 130, 130', 200 and 202 are made of glass reinforced nylon. The engagement elements 96 also may be made of glass reinforced nylon. In addition, the pads 41 and 244, the exterior housing 222, the body 224 and the pin 236 may be made of a thermoplastic elastomer.

The foregoing description is provided to illustrate the invention, and is not to be construed as a limitation. Numerous additions, substitutions and other changes can be made to the invention without departing from its scope as set forth in the appended claims.

We claim:

1. An adjustable jaw supported on a support element, said adjustable jaw comprising:

a clamping jaw comprising a jaw body and a clamping face attached thereto, wherein said jaw body comprises a first opening to receive said support element; and an engagement element attached to said jaw body and movable relative to said jaw body from a first position to a second position, wherein when said engagement element is located at said first position said jaw body is able to move relative to said support element and when said engagement element is located at said second position said jaw body is unable to substantially move relative to said support element irrespective of whether said jaw body moves while said engagement element moves from said first position to said second position and irrespective of whether said engagement element contacts said support element.

2. The adjustable jaw of claim 1, wherein said engagement element partially blocks said opening when at said second position.

3. The adjustable jaw of claim 1, wherein said engagement element is absent from said opening when at said first position.

4. The adjustable jaw of claim 2, wherein said engagement element is absent from said opening when at said first position.

5. The adjustable jaw of claim 1, wherein said engagement element comprises a U-shaped blocker that partially blocks said opening when at said second position.

6. The adjustable jaw of claim 1, wherein said engagement element comprises a U-shaped blocker that is absent from said opening when at said first position.

7. The adjustable jaw of claim 5, wherein said opening is shaped so as to have a central area that receives said support element and an adjacent area that is blocked by said U-shaped blocker when at said second position.

8. The adjustable jaw of claim 7, wherein said opening is generally shaped in the shape of a cross.

9. The adjustable jaw of claim 1, wherein said engagement element engages an exterior surface of said jaw body.

10. The adjustable jaw of claim 9, wherein said engagement element comprises a base and a pair of legs that engage said exterior surface.

11. The adjustable jaw of claim 10, wherein said jaw body comprises an indent that is engaged by one of said pair of legs when said engagement element is at said first position.

12. The adjustable jaw of claim 10, wherein said jaw body comprises an indent that is engaged by one of said pair of legs when said engagement element is at said second position.

13. The adjustable jaw of claim 12, wherein said jaw body comprises a second indent that is engaged by one of said pair of legs when said engagement element is at said second position.

14. The adjustable jaw of claim 10, wherein said engagement element comprises a U-shaped blocker that partially blocks said opening when at said second position.

15. The adjustable jaw of claim 10, wherein said engagement element comprises a U-shaped blocker that is absent from said opening when at said first position.

16. The adjustable jaw of claim 1, wherein said clamping jaw comprises a lower locking pin and an upper locking pin that are adjacent to opposite sides of said support element.

17. The adjustable jaw of claim 16, wherein said lower locking pin and said upper locking pin are separated from one another along a diagonal.

18. The adjustable jaw of claim 16, wherein said upper locking pin and said lower locking pin lock said clamping jaw onto said support element by rotating so as to engage said support element.

19. The adjustable jaw of claim 1, wherein said clamping face is attached to a screw, wherein rotation of the screw causes the clamping face to translationally move.

20. The adjustable jaw of claim 19, wherein said clamping face comprises a shaft with an interior portion into which said screw is inserted.

21. The adjustable jaw of claim 20, wherein said interior portion comprises threads that engage said screw so that rotation of said screw causes said shaft and clamping face to translationally move.

22. The adjustable jaw of claim 1, wherein said engagement element moves in a translational manner from said first position to said second position.

23. The adjustable jaw of claim 1, wherein said engagement element moves substantially only in a translational manner from said first position to said second position.

24. An adjustable jaw supported on a support element, said adjustable jaw comprising:

a clamping jaw comprising a jaw body and a clamping face attached thereto, wherein said jaw body comprises a first opening to receive said support element and wherein said clamping face is attached to a screw, wherein rotation of said screw causes said clamping face to translationally move and, wherein said screw fails to translationally move during rotation of said screw; and an engagement element attached to said jaw body and movable relative to said jaw body from a first position to a second position, wherein when said engagement element is located at said first position said jaw body is able to move relative to said support element and when said engagement element is located at said second position said jaw body is unable to move relative to said support element irrespective of whether said jaw body moves while said engagement element moves from said first position to said second position.

25. An adjustable jaw supported on a support element, said adjustable jaw comprising:

a clamping jaw comprising a jaw body and a clamping face attached thereto, wherein said jaw body comprises a first opening to receive said support element wherein said clamping face is attached to a screw, wherein said clamping face comprises a shaft with an interior portion into which said screw is inserted, said interior portion comprises threads that engage said screw, wherein rotation of said screw causes said shaft and clamping face to translationally move and wherein said screw fails to translationally move during rotation of said screw; and an engagement element attached to said jaw body and movable relative to said jaw body from a first position to a second position, wherein when said engagement element is located at said first position said jaw body is able to move relative to said support element and when said engagement element is located at said second position said jaw body is unable to move relative to said support element irrespective of whether said jaw body moves while said engagement element moves from said first position to said second position.

26. An adjustable clamping jaw apparatus comprising:

a support element comprising a stop element;

a clamping jaw comprising a jaw body and a clamping face attached thereto, wherein said jaw body comprises a channel, wherein said stop element is positioned within said channel; and an engagement element attached to said jaw body and positioned to block a first end of said channel and a second end of said channel so that said stop element is trapped between said first and second ends of said channel.

27. The adjustable clamping jaw apparatus of claim 26, wherein said engagement element partially blocks said channel.

28. The adjustable clamping jaw apparatus of claim 26, wherein said engagement element is movable relative to said jaw body to a position where said stop element is free to be removed through either said first end or said second end.

29. The adjustable clamping jaw apparatus of claim 28, wherein said engagement element moves in a translational manner to said position.

30. The adjustable clamping jaw apparatus of claim 28, wherein said engagement element moves substantially only in a translational manner to said position.

31. The adjustable clamping jaw apparatus of claim 26, wherein said support element comprises a rod that extends along a longitudinal axis of said channel.

32. The adjustable clamping jaw apparatus of claim 31, wherein said stop element extends substantially perpendicular to said longitudinal axis.

33. The adjustable clamping jaw apparatus of claim 26, wherein said support element comprises a bar that extends along a longitudinal axis of said channel.

34. The adjustable clamping jaw apparatus of claim 33, wherein said stop element extends substantially perpendicular to said longitudinal axis.

35. The adjustable clamping jaw apparatus of claim 26, wherein said engagement element comprises a first blocker that blocks said first end and a second blocker that blocks said second end.

36. The adjustable clamping jaw apparatus of claim 35, wherein said first blocker is parallel to said second blocker.

37. The adjustable clamping jaw apparatus of claim 36, wherein said first blocker is separated from said second blocker by an amount that is approximately equal to the thickness of said stop element.

38. The adjustable clamping jaw apparatus of claim 35, wherein said first blocker is U-shape.

39. The adjustable clamping jaw apparatus of claim 38, wherein said second blocker is U-shaped.

40. The adjustable clamping jaw apparatus of claim 26, wherein said channel has a cross-sectional shape comprising a central area that receives said support element and an adjacent area that receives said stop element.

41. The adjustable clamping jaw apparatus of claim 40, wherein said cross-sectional shape is generally shaped in the shape of a cross.

42. The adjustable clamping jaw apparatus of claim 26, wherein said engagement element comprises a base and a pair of legs that engage an exterior surface of said jaw body.

43. The adjustable clamping jaw apparatus of claim 42, wherein said jaw body comprises an indent that is engaged by one of said pair of legs.

44. The adjustable jaw of claim 26, wherein said clamping jaw comprises a lower locking pin and an upper locking pin that are adjacent to opposite sides of said support element.

45. The adjustable jaw of claim 44, wherein said lower locking pin and said upper locking pin are separated from one another along a diagonal.

46. The adjustable jaw of claim 44, wherein said upper locking pin and said lower locking pin lock said clamping jaw onto said support element by rotating so as to engage said support element.

47. The adjustable jaw of claim 26, wherein said clamping face is attached to a screw, wherein rotation of the screw causes the clamping face to translationally move.

48. The adjustable jaw of claim 47, wherein said clamping face comprises a shaft with an interior portion into which said screw is inserted.

49. The adjustable jaw of claim 48, wherein said interior portion comprises threads that engage said screw so that rotation of said screw causes said shaft and clamping face to translationally move.

50. The adjustable jaw of claim 49, wherein said screw fails to translationally move during rotation of said screw.

51. The adjustable jaw of claim 47, wherein said screw fails to translationally move during rotation of said screw.

* * * * *

UNITED STATES PATENT AND TRADEMARK OFFICE

CERTIFICATE OF CORRECTION

PATENT NO. : 6,412,767 B1 
DATED : July 2, 2002
INVENTOR(S) : Toby Jay Beckmann et al.

It is certified that error appears in the above-identified patent and that said Letters Patent is hereby corrected as shown below:

Title page,
Item [75], delete "Zlomke, Beatrice, all" and substitute -- Zlomke, Grand Island, all -- in its place.
Item [56], References Cited, FOREIGN PATENT DOCUMENTS, delete "54745" and substitute -- 54742 -- in its place.

Signed and Sealed this

Twenty-eighth Day of January, 2003

JAMES E. ROGAN
*Director of the United States Patent and Trademark Office*